US006024032A

United States Patent [19]

Sharpe

[11] Patent Number: 6,024,032

[45] Date of Patent: Feb. 15, 2000

[54] PRODUCTION OF HEAT ENERGY FROM SOLID CARBONACEOUS FUELS

[75] Inventor: John Ernest Elsom Sharpe, Beckenham, United Kingdom

[73] Assignee: Compact Power Limited, United Kingdom

[21] Appl. No.: 09/051,910

[22] PCT Filed: Oct. 25, 1996

[86] PCT No.: PCT/GB96/02169

§ 371 Date: Apr. 27, 1998

§ 102(e) Date: Apr. 27, 1998

[87] PCT Pub. No.: WO97/15641

PCT Pub. Date: May 1, 1997

[30] Foreign Application Priority Data

Oct. 26, 1995 [GB] United Kingdom ..... 9521950
Oct. 26, 1995 [GB] United Kingdom ..... 9521984

[51] Int. Cl.[7] ..... F23B 7/00; F23B 5/00

[52] U.S. Cl. ..... 110/342; 110/344; 110/345; 110/109; 110/110; 110/204; 110/210; 110/211; 110/289; 110/297

[58] Field of Search ..... 110/203, 204, 110/205, 208, 210, 211, 214, 229, 235, 253, 255, 259, 289, 342, 344, 345, 346, 347, 11 R, 109, 110, 114

[56] References Cited

U.S. PATENT DOCUMENTS

| | | | |
|---|---|---|---|
| 1,510,045 | 9/1924 | Day | 110/342 X |
| 1,839,741 | 1/1932 | Davies, Jr. | 110/342 X |
| 3,548,762 | 12/1970 | Anderson et al. | 110/210 |
| 3,808,986 | 5/1974 | Logdon | 110/210 |
| 4,308,807 | 1/1982 | Stokes | 110/346 X |
| 4,318,713 | 3/1982 | Lee et al. | 48/203 |
| 4,354,440 | 10/1982 | McRee, Jr. | 110/346 |
| 4,495,872 | 1/1985 | Shigaki | 110/190 |
| 4,531,462 | 7/1985 | Payne | 110/210 |
| 4,541,345 | 9/1985 | Grumpelt et al. | 110/229 |
| 4,676,177 | 6/1987 | Engstrom | 110/210 X |
| 5,170,725 | 12/1992 | Sass et al. | 110/346 X |
| 5,279,234 | 1/1994 | Bender et al. | 110/346 X |
| 5,311,830 | 5/1994 | Kiss | 110/346 |
| 5,657,706 | 8/1997 | Liagre et al. | 110/346 X |

FOREIGN PATENT DOCUMENTS

| | | |
|---|---|---|
| 0 120 397 | 10/1984 | European Pat. Off. . |
| 43 27 320 | 3/1994 | Germany . |
| WO 85/01096 | 3/1985 | WIPO . |

*Primary Examiner*—Ira S. Lazarus
*Assistant Examiner*—Ljiljana V. Ciric
*Attorney, Agent, or Firm*—Bacon & Thomas, PLLC

[57] ABSTRACT

A process for the production of heat energy from solid carbonaceous fuels is disclosed which comprises subjecting the carbonaceous fuel to substantially anaerobic pyrolysis in at least one first zone and thereafter transferring the char resulting from the pyrolysis to a second zone which is segregated from the first zone or zones. The char is subjected to gasification in the second zone by introduction of primary combustion air, optionally with steam and/or recycled exhaust gas. The off gases from the second zone and the pyrolysis gases from the first zone or zones are thereafter subjected to secondary combustion and the first zone or zones is heated by heat derived from the secondary combustion. Ash is removed from the bottom of the second zone.

22 Claims, 4 Drawing Sheets

PRODUCTION OF HEAT ENERGY FROM SOLID CARBONACEOUS FUELS

BACKGROUND OF THE INVENTION

1. Field of the Invention

This invention relates to the production of heat energy from solid carbonaceous fuels, for example solid wastes.

2. Description of Related Art

In conventional deep bed proces for the production of heat energy from solid carbonaceous fuels, a deep bed is formed in which primary combustion air with optional additional steam and/or other additives or recycled gases are introduced at or near the bottom of the bed causing partial oxidation and gasification of the char in the lower part of the bed whilst in the upper part of the bed pyrolysis of the freshly introduced fuel yields pyrolysis gas and char which sinks lower in the bed to be subjected to the aforementioned gasification process, the mixture of gases thus produced from the deep bed being thereafter mixed with secondary combustion air and burnt to produce heat energy.

Such a process is described in our co-pending U.K. Patent Application No. 9511090.4 which claims a process for producing heat energy from solid carbonaceous fuels having relatively high ash contents which process comprises subjecting the fuel to pyrolysis and gasification in a bed of the fuel in a combustion chamber, the fuel being reacted with primary air together with steam and/or water vapour and/or recycled exhaust gas, the gas produced from the bed being thereafter subjected to secondary combustion, wherein the fuel bed is unsupported by a grate, the primary air being introduced into the fuel bed by means of one or more apertured tubes projecting into and/or through the bed, and the ash resulting from the pyrolysis and gasification being continually removed from the bottom of the combustion chamber in a particulate and unclinkered state.

Other processes are known in which carbonaceous fuels are conveyed through a substantially horizontal or inclined reaction chamber whilst being subjected to combustion, optionally with addition of steam, so that the fuel is progressively pyrolysed and gasified as it passes through the chamber.

However, in such processes there is no clear boundary between the zones in which the respective pyrolysis and gasification steps take place even though the process may be conducted in a stagewise fashion and a consequence of this is that it is difficult to control the two different steps which are in fact quite different chemical processes and which have different requirements, and also to control the secondary combustion step, and therefore there is a problem that the overall process cannot be managed as efficiently as it might be. It is desirable to be able to control these process steps independently and thereby to optimise the overall process, in particular to enable a wide range of fuels and wastes to be handled in the process, and in apparatus designed for the processing of a wide range of fuels or wastes.

Furthermore, of course, it is desirable that the separate controllability should be achieved in a compact manner by means of relatively simple robust apparatus without introducing complexities which might offset any advantages obtained by separately controlling the gasification and pyrolysis steps.

Additionally, of course, any such separate controllability should be achieved without loss, or with minimum loss, in the thermal efficiency of the overall process.

DE 4 327 320 A1 describes a process and apparatus for the thermal disposal of waste including an initial step in which the waste is degasified in a degasification tube. The degasification tube is heated indirectly by energy derived from a waste heat boiler which extracts heat from flue gases derived from secondary combustion of gaseous products from the waste.

When the term "air" is used in this specification it is of course intended that any gas or mixture of gases comprising oxygen and which will effect combustion is within the scope of the disclosure.

SUMMARY OF THE INVENTION

According to the present invention there is provided a process for the production of heat energy from solid carbonaceous fuels which process comprises subjecting the carbonaceous fuel to substantially anaerobic pyrolysis in at least one first zone and thereafter transferring the char resulting from the pyrolysis to a second zone which is segregated from the first zone or zones, the char being subjected to gasification in the second zone by introduction of primary combustion air, optionally with steam and/or recycled exhaust gas, the off gases from the second zone and the pyrolysis gases from the first zone being thereafter subjected to secondary combustion and the first zone or zones being heated by heat derived from said secondary combustion, ash being removed from the bottom of the second zone.

Also provided by the present invention is an apparatus for the production of heat energy from solid carbonaceous fuels by pyrolysis and gasification which apparatus comprises a reaction chamber having a pyrolysis zone spaced horizontally from and situated at a higher level than the gasification zone and suitable for carrying out substantially anaerobic pyrolysis, means being provided for introducing solid carbonaceous fuel into said pyrolysis zone and for moving the char resulting from pyrolysis of the fuel to the gasification zone, the gasification zone being provided with means for infusing primary combustion air, and optionally steam and/or recycled exhaust gases, and also means for removal of ash from the bottom of the zone, means also being provided for introducing secondary combustion air into the off gas from the pyrolysis zone and the water gas or producer gas from the gasification zone, and means for using at least part of the heat resulting from the secondary combustion to heat the pyrolysis zone.

The aforementioned spacing or segregation of the pyrolysis and gasification steps may be achieved by means of a one or more radiantly heated shelves in the reaction chamber or apparatus onto which the solid carbonaceous fuel is first loaded and then allowed to pyrolyse in the radiant heat before the carbon char remaining is transferred into the deep bed of the gasification zone and reduced to an ash which is removed from the bottom of the bed.

The geometry of such a shelf is important as is the geometry of the inside of the reaction chamber in the area where secondary combustion takes place because it is the heat emanating from the internal surface of chamber, which is heated by radiation from the secondary combustion which takes place in the region of 1100 to 1300° C., which effects the pyrolysis of the fuel. The internal surface of the reaction chamber in this case is preferably in the form of a curved roof over the combustion space and the pyrolysing shelf. The shelf itself is spaced horizontally from and is situated at a higher level than the deep bed and is preferably inclined downwardly away from the zone of the deep bed so as to stop char falling accidentally into the deep bed before an appropriate time is reached for it to be deliberately transferred. Transfer of the char to the deep bed may in this case be readily effected by means by one or more rams which are provided with suitable insulation and cooling.

An alternative arrangement for the pyrolysing zone may be that of a moving grate which discharges into the deep bed.

However, a particularly preferred form of pyrolysis zone is a tubular reactor through which the solid fuel is passed and the tubular reactor is heated by the hot gases derived from said secondary combustion. Preferably the tubular reactor is so arranged that at least part of the hot gases produced by the secondary combustion are passed around the tubular reactor so as to heat the carbonaceous fuel contained therein to pyrolyse it. Also preferred in this form of the invention is a feed means for feeding the solid carbonaceous fuel though each pyrolysis zone or zones and ejecting the resulting char into the gasification zone which ideally is in the form of screw feed means, or includes such screw feed means, as this has been found to be particularly effective in cases where other types of feeding means such as rams, when used alone, have resulted in jamming when using certain types of carbonaceous fuel, particularly particulate fuels.

The use of a screw feed thus enables a wider range of carbonaceous fuels to be used but also enables better control of the pyrolysis step itself in relation to the process as a whole, thus serving to further enhance the technical advantages of the present invention which derive from the clear separation of the anaerobic pyrolysis and aerobic gasification steps and the efficient use of the heat derived from the secondary combustion.

It will be appreciated that the apparatus may be in the form of a plurality of pyrolysis zones, shelves or grates which can discharge char into a single gasifying zone or into a plurality of such zones. Thus a plurality of pyrolysis shelves or reactor tubes may be arranged above and surrounding a single deep fuel bed or additionally or alternatively, for example, may be arranged one above another.

Separate secondary combustion air inlet tubes may be provided in the reaction chamber respectively for the pyro gas and the producer/water gas so as to provide an appropriate distribution of the secondary combustion air. The primary combustion air/steam is provided with a separate control and the fuel feeding rate and the carbon char transfer rate can also be controlled separately so as to provide an appropriate total heat output and an appropriate residence time for the fuel in the pyrolysis zone or zones.

It will be seen that segregation of the pyrolysis and gasification zones having different reaction conditions as described above and as exemplified hereafter enables the pyrolysis process to be controlled separately from the gasification step and also enables the secondary combustion step to be controlled in relation to the pyrolysis (pyro) gas and the producer/water gas separately.

The hot gas which is produced in the secondary combustion can of course conveniently be used for steam production in a boiler and the steam thereafter used, for example, for electricity generation in a conventional manner.

It will also be appreciated that standard incinerator equipment can be readily modified to operate in accord with the present invention with minimal adaptation of the existing apparatus, thereby reducing capital expenditure on new plant whilst deriving benefit from controllability and hence enabling a wide range of wastes to be treated for efficient recovery of heat energy.

Following is the description by way of example with reference to the accompanying drawings of processes and apparatus in accord with this invention.

BRIEF DESCRIPTION OF THE FIGURES OF DRAWINGS

DETAILED DESCRIPTION OF THE PREFERRED EMBODIMENTS

Figure 1:
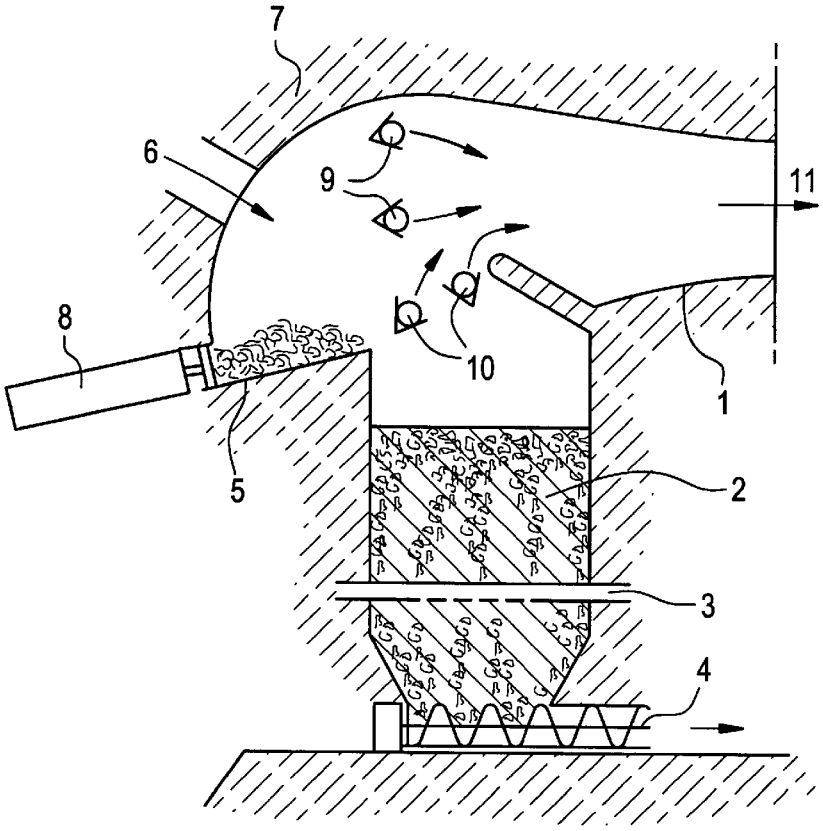
FIG. 1 represents diagrammatically an apparatus in accord with the invention.

In FIG. 1, a reaction chamber (1) is provided with a substantially vertically walled zone (2) for performing the gasification of char in a deep fuel bed, a steam/air inlet (3) being provided near the base of the zone in the form of one or more orificed pipes extending across the cross section of the zone and screw means (4) being provided at the base of the reaction chamber for removal of ash resulting from the gasification of the char.

At (5) is provided a shelf which is inclined upwardly towards the edge of the pyrolysis zone and to which fuel is fed through opening (6). The fuel on the pyrolysis shelf (5) is subjected to pyrolysis through heat radiating from the upper curved refractory wall (7) of the reaction chamber.

A ram (8) is provided adjacent the pyrolysis shelf to enable char resulting from the pyrolysis process to be pushed over the edge of the shelf and into the deep fuel char bed for gasification. The said ram means (8) may also of course be adapted for the introduction of the fuel into the chamber, instead of through opening (6).

Secondary air inlet tubes (9,10) are provided in the spaces above the pyrolysis shelf and deep fuel gasification bed respectively to provide air for secondary combustion of the gases emanating respectively from these two reaction zones.

As mentioned previously, heat from the secondary combustion is intercepted by the curved refractory roof (7) which in turn radiates heat onto the pyrolysis shelf to cause pyrolysis of the fuel thereon.

Exhaust heat from the reactor chamber exits at (11) and is conveyed to a boiler for conversion, for example, to steam for electricity generation in a conventional manner.

Figure 2:
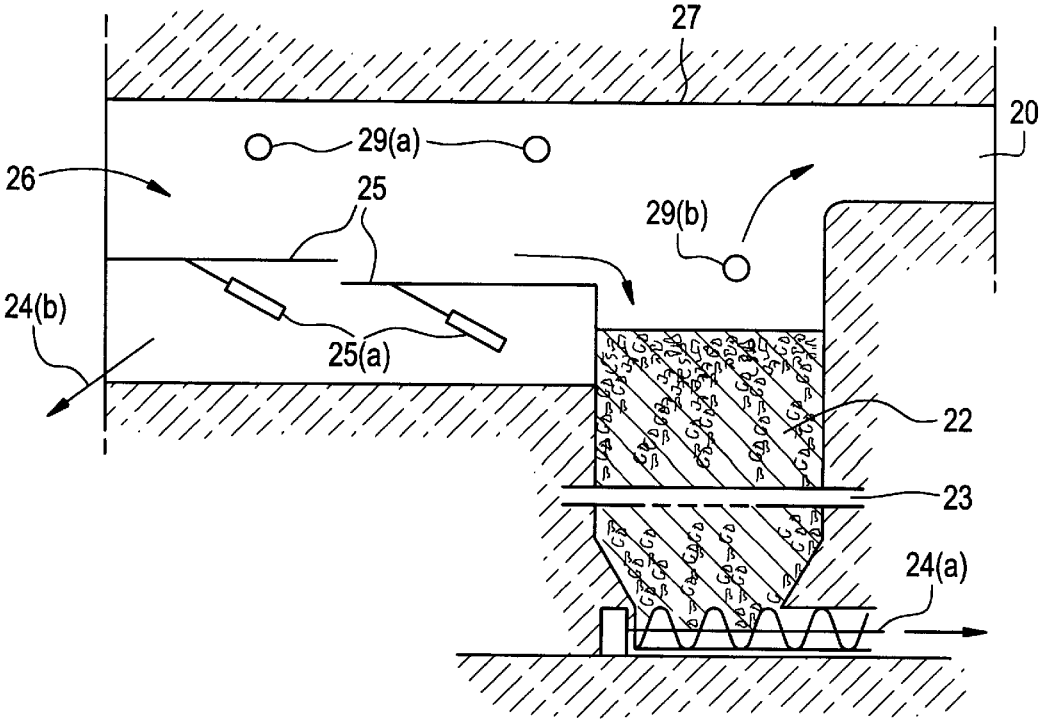
FIG. 2 shows diagrammatically how a standard incinerator can be adapted for separate pyrolysis and gasification in accord with the present invention.

In FIG. 2 an arrangement is shown whereby a standard incinerator can be adapted to carry out separate pyrolysis and gasification in accord with the process of this invention.

A vertically arranged deep bed gasifying zone (22) is arranged similarly to that in the apparatus shown in FIG. 1, being provided with a steam/air inlet tube (23) for primary air/steam and ash removal screw means **(24(*a*))**.

Situated above the deep bed zone (22) is a rocking pyrolysing grate (25) which is actuated by actuators **(25(*a*)) and fed with fuel through opening (26). The pyrolysing grate is heated by radiant heat from the roof of the reaction chamber (27)**.

Also provided in the chamber are secondary air inlet tubes (29(*a*) and 29(*b*)) respectively over the pyrolysing grate and the gasification deep bed, the hot gases being exhausted to a steam boiler at (20).

Ash is also removed from under the pyrolysing grate at (24(*b*)).

It will be seen that the arrangement in FIG. 2 works similarly to that shown in FIG. 1 in that the pyrolysis and gasification processes are carried out in segregated zones having different reaction conditions, enabling them to be separately controlled.

Figure 3:
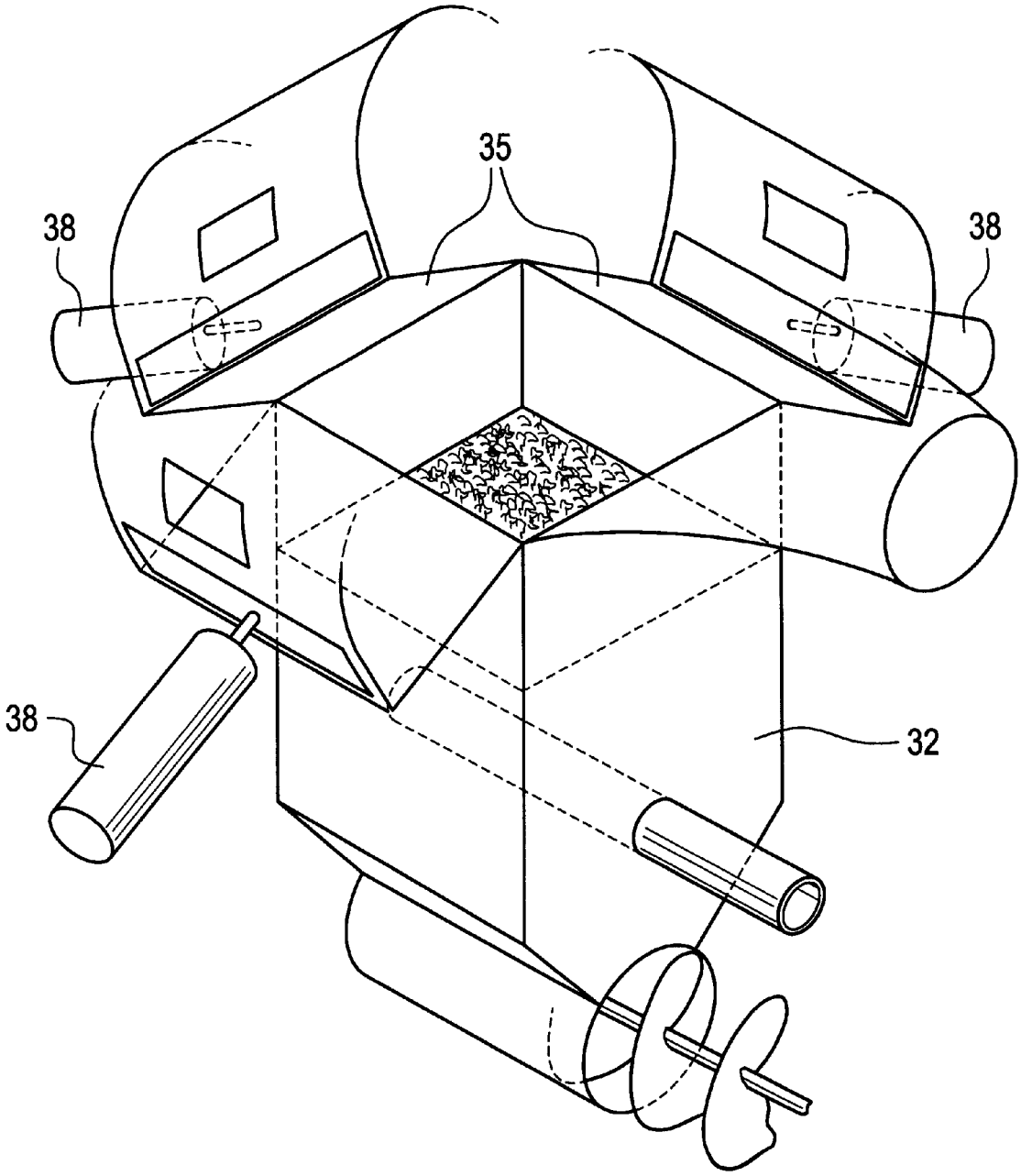
FIG. 3 represents diagrammatically how a plurality of pyrolysis shelves may be arranged around one deep gasifying bed.

In FIG. 3 it is shown how a plurality of pyrolysis shelves (35) each having a reverse slope and provided with a char pusher or ram (38) can be arranged around a single deep bed gasification bed (32) for treating the char resulting from the gasification of fuel fed to each of the pyrolysis shelves (35).

Figure 4:
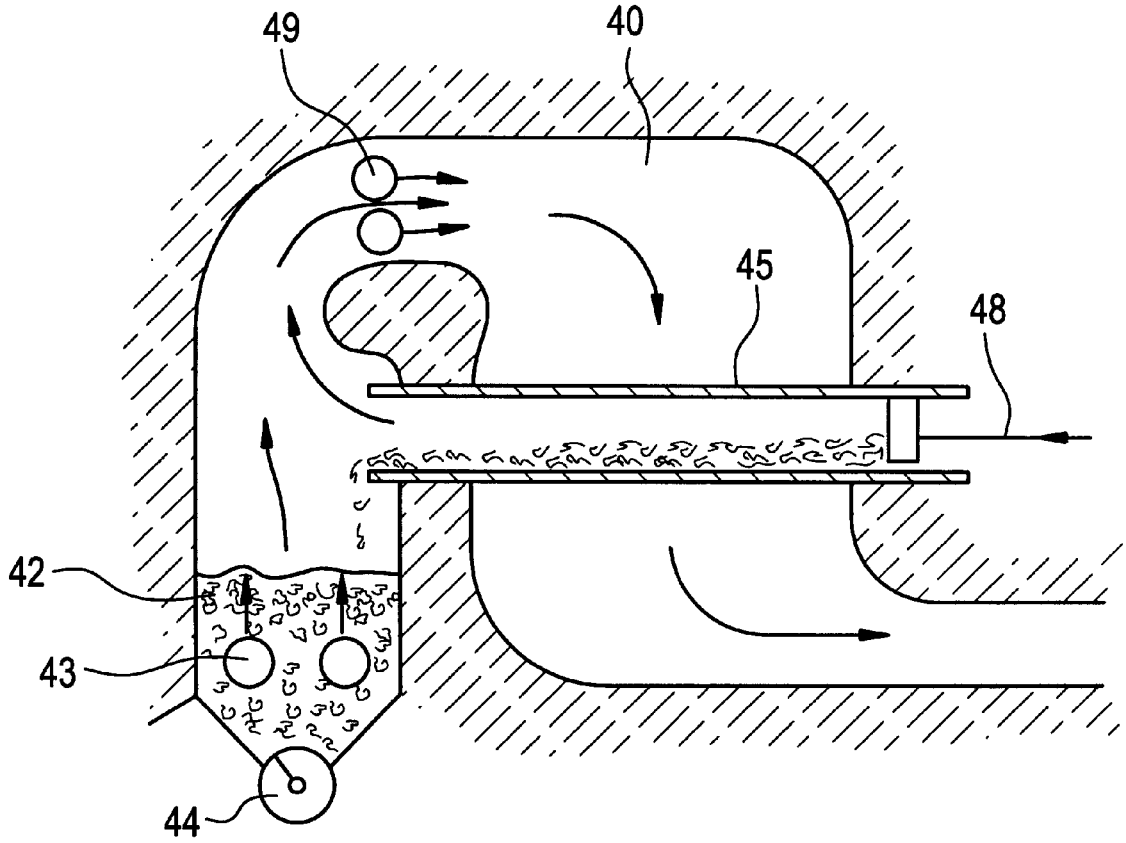
FIG. 4 represents diagrammatically an alternative and preferred embodiment of the apparatus of the invention using a pyrolysis reactor tube instead of a shelf for the first separate pyrolysing zone.

In FIG. 4 is shown a diagrammatic vertical section of an alternative and preferred apparatus for carrying out the invention, using a pyrolysis reaction tube instead of a pyrolysis shelf.

It will be seen that in this case a reaction tube (45) is fed with carbonaceous fuel by means of a feed ram (48) and forms a pyrolysis zone separate from the second zone (42) which is a deep bed gasification zone supplied with primary air and optionally steam or recycled exhaust gas at (43), ash being removed from the bottom of the second zone by a suitable arrangement (44). Pyro gases from the pyrolysis tube and producer/water gas from the deep bed gasification zone both pass upwards through the refractory insulated chamber to be supplied with secondary air at inlets (49) to give secondary combustion in the thermal reactor (40) the gases from which pass around the pyrolysis tube (45) and heat it to a degree sufficient to produce pyrolysis. Typically the temperature of the gases from the thermal reactor are in the range 800° C. to 1300° C. Using the feed ram (48) the pyrolysed char is caused to exit the pyrolysis tube and drop into the gasification zone (42). It will be seen in this case that instead of the type of arrangement shown in FIGS. 1 to 3 where the heat for the pyrolysis stage is derived mainly as radiant heat from the secondary combustion, in the arrangement of FIG. 4 the hot gases from the secondary combustion are passed around the pyrolysis tube and this enables more efficient heating for the pyrolysis process.

Figure 5:
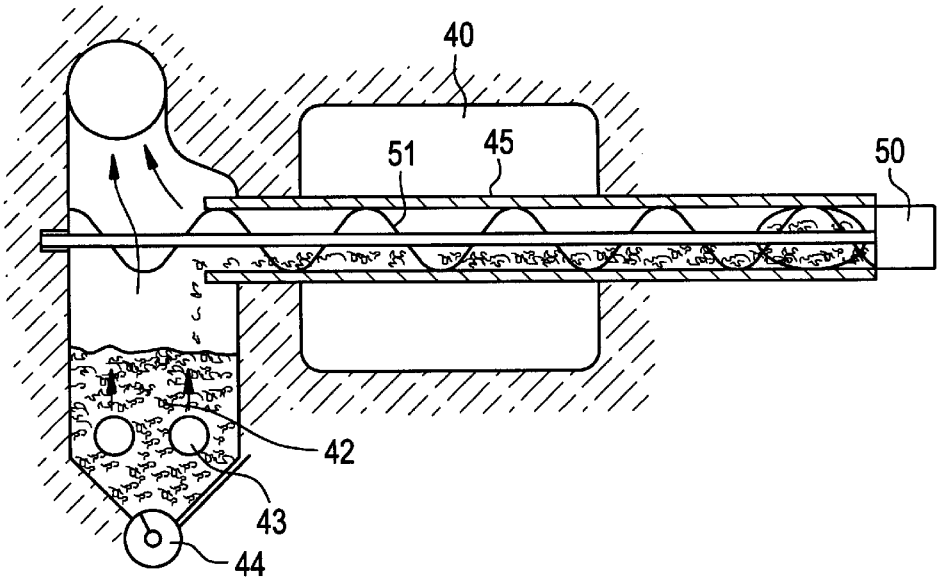
FIGS. 5 and 6 show respectively a vertical and plan section of a diagrammatic representation of a more specific arrangement of the apparatus of FIG. 4 using two pyrolysis reactor tubes and ancillary feeding arrangements and also showing the arrangement of the thermal reactor where secondary combustion takes place generating the hot gases to heat the pyrolysis reactor tubes.
Figure 6:
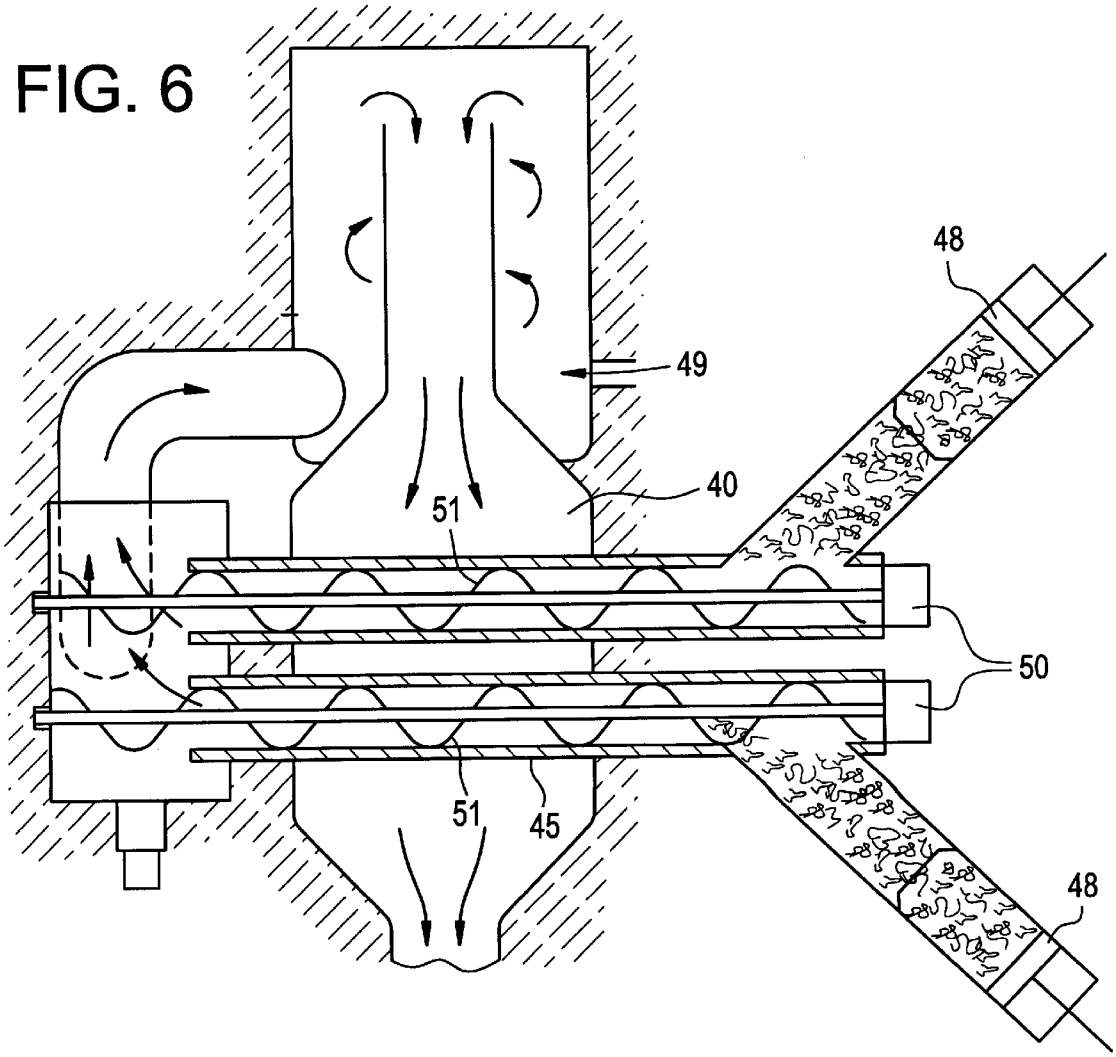

FIGS. 5 and 6 show in more detail diagrammatically a practical arrangement of the apparatus shown in FIG. 4 using two pyrolysis tubes and a vortex thermal reactor together with specific means for feeding the pyrolysis tubes embodying screw means for enabling or assisting the passage of the fuel being pyrolysed through the tubes and also a feed ram arrangement for introducing the carbonaceous fuel material into the pyrolysis tubes. In FIGS. 5 and 6 the same reference numerals are used as in FIG. 4 for corresponding features.

Numerous variations of the above specifically described processes and apparatus will be apparent to the skilled worker without departing from the scope of the invention as claimed in the following claims.

I claim:

1. A process for the production of heat energy from solid carbonaceous fuels which process comprises:

heating a carbonaceous fuel in at least one first zone to a temperature which is sufficiently high to substantially pyrolyse the fuel anaerobically producing a char and pyrolysis gases, transferring the char resulting from the pyrolysis to a second zone which is segregated from the first zone or zones, subjecting the char to gasification in the second zone by introducing primary combustion air to produce off gases and ash, subjecting the off gases from the second zone and the pyrolysis gases from the first zone or zones to secondary combustion, and removing the ash from the bottom of the second zone, wherein the first zone or zones are heated mainly by radiant heat derived directly from said secondary combustion.

2. A process as claimed in claim 1, wherein the first zone or zones is provided by one or more shelves in a reaction chamber having a roof and the one or more shelves are radiantly heated by heat radiated from the roof of the reaction chamber.

3. A process as claimed in claim 2, wherein each pyrolysis shelf slopes downwardly, away from the second zone in order to prevent the fuel which is being pyrolysed from dropping prematurely into the second zone.

4. A process as claimed in claim 2, wherein the roof of the reaction chamber is shaped to focus heat from the secondary combustion onto each pyrolysing shelf.

5. A process as claimed in claim 2, wherein means are provided to move pyrolysed fuel from each pyrolysing shelf into the second zone comprised of a deep fuel gasifying bed.

6. A process as claimed in claim 1, wherein secondary combustion air is supplied separately to pyrolysis gases resulting from the pyrolysed fuel from the first zone or zones and to producer/water gas emanating from the second zone comprised of a deep fuel gasifying bed.

7. A process as claimed in claim 1, wherein the first zone is provided by a tubular reactor through which the solid fuel is passed and the tubular reactor is heated directly by radiant heat from the hot gases derived from said secondary combustion.

8. A process as claimed in claim 1, wherein the secondary combustion is performed at a temperature of 1100° C. to 1300° C.

9. A process as claimed in claim 1, further comprising introducing steam with the primary combustion air in the second zone.

10. A process as claimed in claim 1, further comprising introducing recycled exhaust gases with the primary combustion air in the second zone.

11. A process as claimed in claim 1, further comprising introducing steam and recycled exhaust gases with the primary combustion air in the second zone.

12. An apparatus for the production of heat energy from solid carbonaceous fuels by pyrolysis and gasification, which apparatus comprises:

a reaction chamber having at least one pyrolysis zone and a gasification zone, said pyrolysis zone or zones being spaced horizontally from and situated at a higher level than said gasification zone and being suitable for carrying out substantially anaerobic pyrolysis, means for introducing solid carbonaceous fuel into said at least one pyrolysis zone and for moving char resulting from pyrolysis of the fuel to the gasification zone, means for infusing primary combustion air into the gasification zone, means for removing ash from the bottom of the gasification zone, means for introducing secondary combustion air into the gas produced in the pyrolysis zone and the gas produced in the gasification zone, and means for using at least part of the heat resulting from the secondary combustion to heat the pyrolysis zone directly and radiantly.

13. An apparatus as claimed in claim 12, wherein the pyrolysis zone is formed by one or more shelves in a reaction chamber into which fuel is deposited above the gasification zone.

14. An apparatus as claimed in claim 13, wherein each shelf is sloped downwardly, away from the gasification zone to prevent premature transfer into the gasification zone of the fuel being pyrolysised.

15. An apparatus as claimed in claim 13, wherein said reaction chamber has a roof which is shaped so as to focus radiant heat from the secondary combustion onto each pyrolysis shelf.

16. An apparatus as claimed in claim 12, further comprising means for radiating part of the heat resulting from the secondary combustion into the pyrolysis zone.

17. An apparatus as claimed in claim 12, wherein the pyrolysis zone is in the form of a tubular reactor leading into an area above the gasification zone and through which the solid carbonaceous fuel passes.

18. An apparatus as claimed in claim 17, wherein the tubular reactor is so arranged that at least part of the gases produced by the secondary combustion are passed around the tubular reactor so as to heat radiantly the carbonaceous fuel contained therein to pyrolyse the fuel.

19. An apparatus as claimed in claim 12, further comprising fuel means for feeding the solid carbonaceous fuel through the pyrolysis zone and for ejecting the resulting char into the gasification zone.

20. An apparatus as claimed in claim 19, wherein said feed means comprise a screw in conjunction with a ram for initial loading of the pyrolysis tube with solid carbonaceous fuel.

21. An apparatus as claimed in claim 12, further comprising means for introducing steam into the gasification zone.

22. An apparatus as claimed in claim 12, further comprising means for introducing recycled exhaust gases into the gasification zone.

* * * * *